US008893675B2

(12) United States Patent
Sugiura

(10) Patent No.: US 8,893,675 B2
(45) Date of Patent: Nov. 25, 2014

(54) VARIABLE VALVE MECHANISM

(71) Applicant: OTICS Corporation, Nishio-Shi (JP)

(72) Inventor: Akira Sugiura, Nishio (JP)

(73) Assignee: OTICS Corporation, Nishio-Shi, Aichi-Ken (JP)

( * ) Notice: Subject to any disclaimer, the term of this patent is extended or adjusted under 35 U.S.C. 154(b) by 18 days.

(21) Appl. No.: 13/887,160

(22) Filed: May 3, 2013

(65) Prior Publication Data

US 2013/0298856 A1 Nov. 14, 2013

(30) Foreign Application Priority Data

May 11, 2012 (JP) ..... 2012-109141

(51) Int. Cl.

| | |
|---|---|
| ***F01L 1/34*** | (2006.01) |
| ***F01L 1/18*** | (2006.01) |
| ***F01L 13/00*** | (2006.01) |

(52) U.S. Cl.

CPC . *F01L 1/34* (2013.01); *F01L 1/185* (2013.01); *F01L 13/0005* (2013.01); *F01L 13/0036* (2013.01); *F01L 2105/00* (2013.01)

USPC ..... 123/90.16; 123/90.39

(58) Field of Classification Search

CPC ..... F01L 1/34; F01L 1/185; F01L 13/0036; F01L 13/0005; F01L 2105/00; F01L 2001/186

USPC ..... 123/90.39, 90.16

See application file for complete search history.

(56) References Cited

U.S. PATENT DOCUMENTS

| | | | | |
|---|---|---|---|---|
| 6,467,444 | B2 * | 10/2002 | Tanaka et al. | 123/90.16 |
| 2004/0237919 | A1 | 12/2004 | Haas et al. | |
| 2005/0132990 | A1 | 6/2005 | Haas et al. | |

FOREIGN PATENT DOCUMENTS

| | | | |
|---|---|---|---|
| DE | 101 55 827 | A1 | 5/2003 |
| WO | WO 2005/075797 | A1 | 8/2005 |

OTHER PUBLICATIONS

Extended European Search Report dated Aug. 23, 2013.

* cited by examiner

*Primary Examiner* — Zelalem Eshete
(74) *Attorney, Agent, or Firm* — McGinn IP Law Group, PLLC

(57) ABSTRACT

The present invention provides a variable valve mechanism for an internal combustion engine which includes an input arm, an output arm, a switching pin, and a displacing device. The displacing device includes a pressing device that presses the switching pin from any one of the coupling position and the non-coupling position to the other one of them, a return spring, and a stopper mechanism. The return spring is provided outside of the input arm and the output arm so as to act on one end of the switching pin, which is exposed from the input arm and the output arm. The stopper mechanism includes a displacement restricting groove that is provided on an outer periphery of the switching pin, and a lock member that is engaged with the displacement restricting groove and contacts one end of the displacement restricting groove when the switching pin is stopped at the non-coupling position.

9 Claims, 11 Drawing Sheets

VARIABLE VALVE MECHANISM

TECHNICAL FIELD

The present invention relates to a variable valve mechanism that changes a driving state of a valve in response to an operating condition of an internal combustion engine.

BACKGROUND ART

Among variable valve mechanisms, there is a variable valve mechanism 109 according to a related art as shown in FIG. 10 to FIG. 11B. The variable valve mechanism 109 includes: an input arm 130; an output arm 140; three switching pins 151, 152 and 153; and a displacing device 159. The input arm 130 rocks as the input arm 130 is pressed by a cam 110. The output arm 140 rocks to actuate a valve 7. The switching pins 151, 152 and 153 are inserted through the input arm 130 and the output arm 140, and are provided so as to be displaceable between a coupling position P and a non-coupling position Q. In the coupling position P, the switching pins 151, 152 and 153 extend across the input arm 130 and the output arm 140. In the non-coupling position Q, the switching pins 151, 152 and 153 do not extend across the input arm 130 and the output arm 140. The displacing device 159 displaces the switching pins 151, 152 and 153.

The displacing device 159 includes: a pressing device 160; a return spring 170; a left stopper mechanism 182; and a right stopper mechanism 183. The pressing device 160 presses the three switching pins 151, 152 and 153 from the right-side coupling position P to the left-side non-coupling position Q. The return spring 170 presses the three switching pins 151, 152 and 153 back from the left-side non-coupling position Q to the right-side coupling position P. The left stopper mechanism 182 stops a displacement of the three switching pins 151, 152 and 153 at the non-coupling position Q. The right stopper mechanism 183 stops the three switching pins 151, 152 and 153 at the coupling position P.

The return spring 170 is interposed between the left end face of the left-end switching pin 151 and the bottom portion of a pin hole in which the left-end switching pin 151 is inserted, and presses the left end face of the left-end switching pin 151 rightward with its restoring force.

The left stopper mechanism 182 is formed of the bottom portion of the pin hole in which the left-end switching pin 151 is inserted. The right stopper mechanism 183 is formed of a ring-shaped protrusion that protrudes inward at a right opening of a pin hole in which the right-end switching pin 153 is inserted.

CITATION LIST

Patent Literature

Patent Literature 1: United State Patent Application Publication No. 2005/132990

SUMMARY OF INVENTION

Technical Problem

However, in the related art, firstly, the return spring 170 is attached to the left side of the left-end switching pin 151 inside the output arm 140, so the output arm 140 increases in size leftward (in the width direction) due to the return spring 170. Therefore, the mass of the output arm 140 increases. This leads to deterioration in fuel economy.

Secondly, the left stopper mechanism 182 is formed of the bottom portion of the left-end pin hole, and the right stopper mechanism 183 is formed of the protrusion that protrudes inward from the right opening of the right-end pin hole, so the output arm 140 increases in size rightward and leftward (in the width direction) due to both the right and left stopper mechanisms 183 and 182. Therefore, in this regard as well, the mass of the output arm 140 increases. This leads to deterioration in fuel economy.

Thirdly, a double-shaft structure in which the switching pin 152 is arranged inside a roller shaft 138 that supports a roller 137 is formed, so the shaft that supports the roller 137 is complex and increases in size in the radial direction. Therefore, the mass of the input arm 130 increases. This leads to deterioration in fuel economy.

Fourthly, the three split switching pins 151, 152 and 153 are required between the input arm 130 and the output arm 140 at the non-coupling position, so the structure of a switching mechanism is complex.

It is an object of the present invention [1] not to increase an input arm or an output arm in size in the width direction due to a return spring, [2] not to increase an input arm or an output arm in size in the width direction due to a stopper mechanism, [3] to form a single-shaft structure by omitting a double-shaft structure in which a switching pin is arranged inside a roller shaft that supports a roller, and [4] to form a single continuous switching pin that is able to switch between the coupling and the non-coupling without splitting the switching pin into multiple pieces between an input arm and an output arm at the non-coupling position.

Solution to Problem

In order to achieve the above objects [1] and [2], a variable valve mechanism for an internal combustion engine of the present invention includes: an input arm that rocks as the input arm is pressed by a cam; an output arm that rocks to actuate a valve; a switching pin that is extended through the input arm and the output arm and that is provided so as to be displaceable between a coupling position at which the switching pin couples the input arm to the output arm such that the input arm and the output arm are relatively non-rockable and a non-coupling position at which the switching pin releases the coupling between the input arm and the output arm; and a displacing device that displaces the switching pin. In the variable valve mechanism, the displacing device includes: a pressing device that presses the switching pin from any one of the coupling position and the non-coupling position to the other one of the coupling position and the non-coupling position; a return spring that presses the switching pin back from the other one of the coupling position and the non-coupling position to the one of the coupling position and the non-coupling position; and a stopper mechanism that stops a displacement of the switching pin at least at the non-coupling position. The return spring is provided outside of the input arm and the output arm so as to act on one end of the switching pin, the one end of the switching pin being exposed from the input arm and the output arm. The stopper mechanism includes: a displacement restricting groove that is provided on an outer periphery of the switching pin and that extends in a direction in which the switching pin displaces; and a lock member that is engaged with the displacement restricting groove and that contacts one end of the displacement restricting groove when the switching pin is stopped at the non-coupling position.

Here, the reason why the phrase "at least a non-coupling position" is used is because the coupling position has a larger range than the non-coupling position and, in many cases, the switching pin does not need to be positioned so accurately at the coupling position as at the non-coupling position. However, more preferably, the stopper mechanism stops a displacement of the switching pin at the coupling position, and the lock member contacts the other end of the displacement restricting groove when the switching pin is stopped at the coupling position. This is because the single stopper mechanism formed of the displacement restricting groove and the lock member is able to restrict a displacement in both directions, that is, a displacement toward the coupling position and a displacement toward the non-coupling position. Thus, when a displacement in both directions is restricted as well, it is possible to collectively form one-side stopper mechanism and the other-side stopper mechanism as one unit, so it is possible to reduce the input arm and the output arm in size in the width direction.

A form of the return spring is not specifically limited; however, examples thereof include the following forms (i) and (ii).

(i) The return spring does not rock together with any of the input arm and the output arm.

(ii) The return spring is attached to the side face of the output arm, and rocks together with the output arm.

In order to achieve the above object [3], preferably, the output arm includes a roller that is pressed by a second cam different from the cam and that rocks the output arm when the coupling between the input arm and the output arm is released, and the switching pin concurrently serves as a roller shaft that supports the roller such that the roller is rotatable. With this configuration, it is possible to form the roller shaft having a single structure. As a result, it is possible to simplify the roller shaft and to reduce the roller shaft in size in the radial direction.

In order to achieve the object [4], preferably, the switching pin is formed of a single pin that extends across the input arm and the output arm at any one of the coupling position and the non-coupling position and that is not split between the input arm and the output arm at the non-coupling position, an escape groove is provided in the single switching pin, the input arm is able to enter the escape groove when the input arm rocks at the non-coupling position, and the input arm is not able to enter the escape groove when the input arm rocks at the coupling position. By providing the escape groove in the switching pin, the single continuous switching pin is able to switch between the coupling and the non-coupling without splitting the switching pin into multiple pieces between the input arm and the output arm at the non-coupling position.

Preferably, the stopper mechanism concurrently serves as a rotation prevention mechanism that prevents rotation of the switching pin with respect to the output arm, and an inner side face of the displacement restricting groove contacts the lock member to prevent the rotation. By fixing the switching pin at a predetermined angle, it is possible to ensure a stroke by which the input arm is able to enter the escape groove as much as possible.

Advantageous Effects of Invention

According to the invention, the return spring is provided outside of the input arm and the output arm, so the input arm or the output arm is not increased in size in the width direction due to the return spring. In addition, the stopper mechanism is formed of the displacement restricting groove provided on the outer periphery of the switching pin and extending in a displacement direction and the lock member engaged with the displacement restricting groove, so the input arm or the output arm is not increased in size in the width direction due to the stopper mechanism.

DESCRIPTION OF EMBODIMENTS

[First Embodiment]

Figure 1:
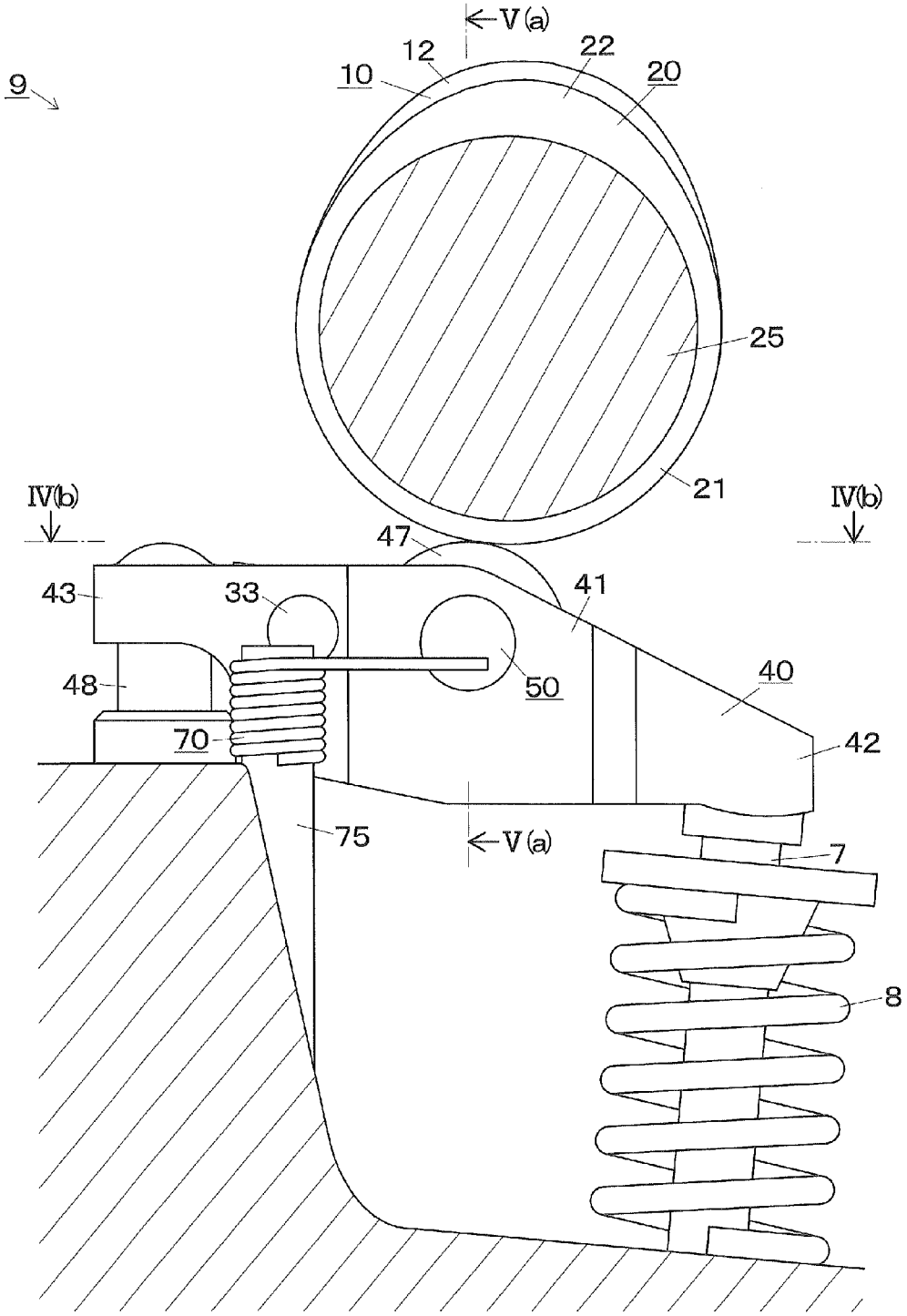
FIG. 1 is a side view showing a variable valve mechanism according to a first embodiment.
Figure 2:
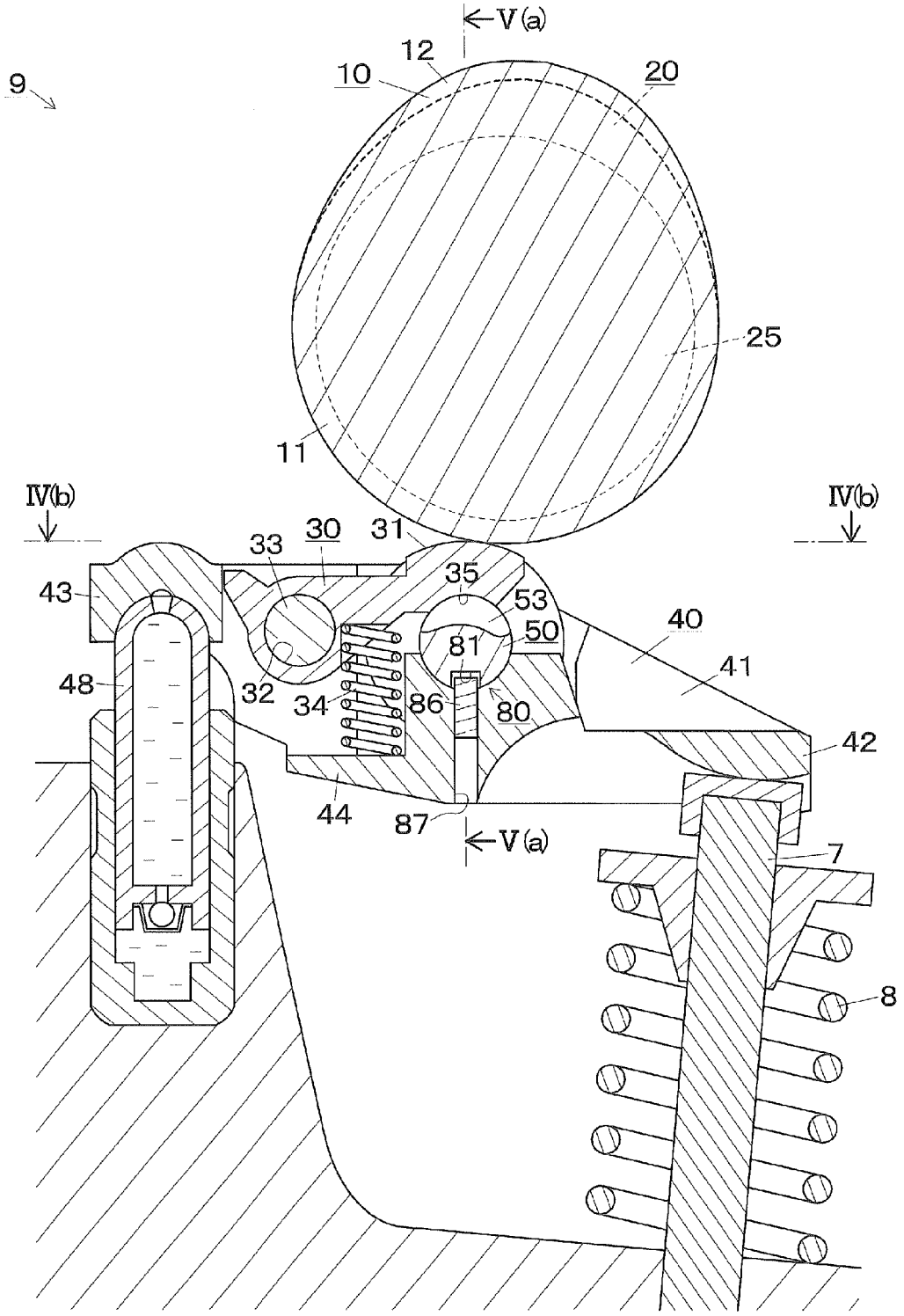
FIG. 2 is a side sectional view showing the variable valve mechanism according to the first embodiment.
Figure 3A:
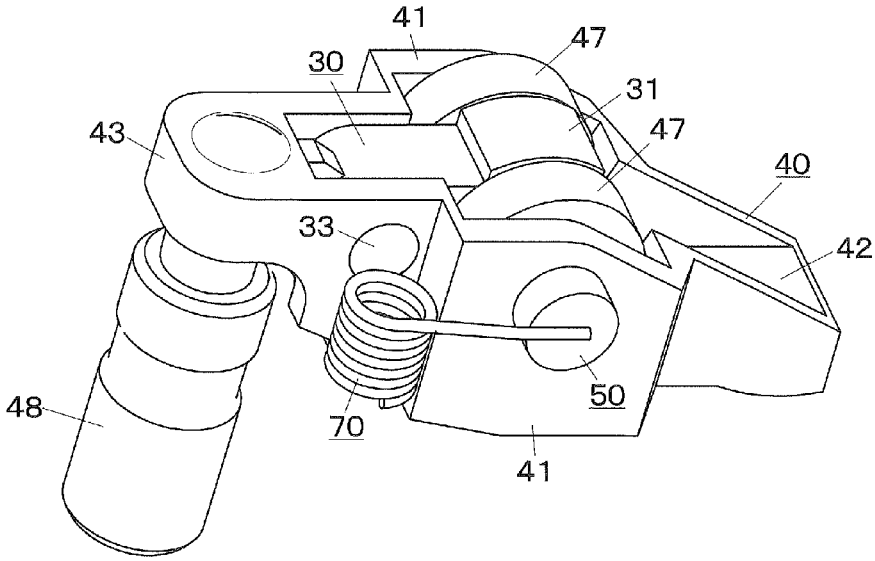
FIG. 3A is a perspective view showing the variable valve mechanism according to the first embodiment.
Figure 3B:
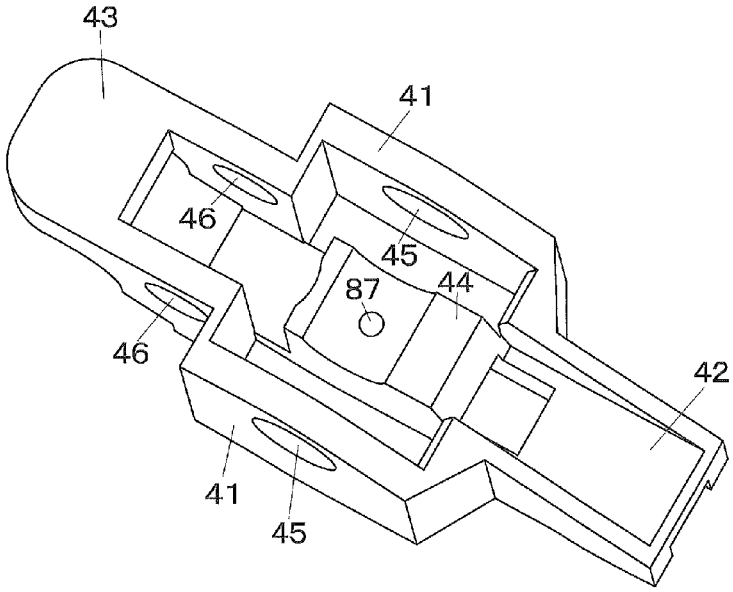
FIG. 3B is a perspective view showing an output arm.
Figure 4A:
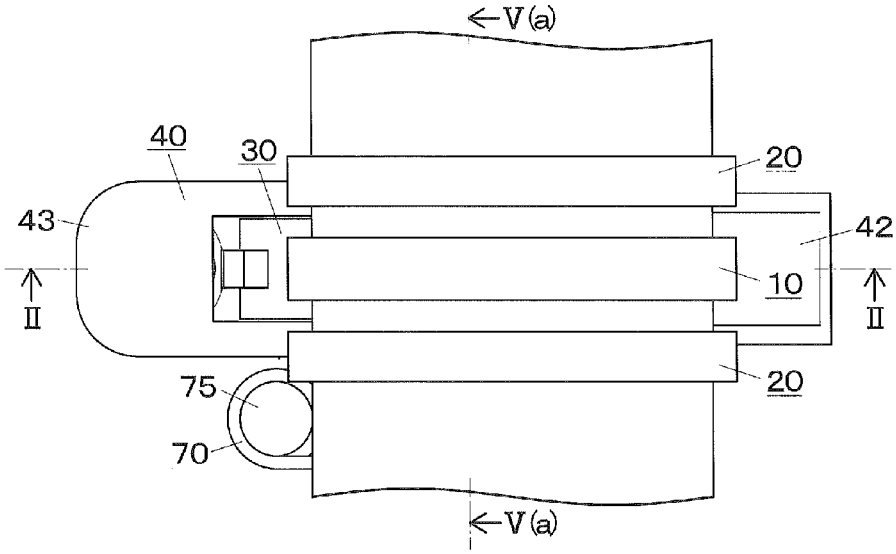
FIG. 4A is a plan view showing the variable valve mechanism according to the first embodiment.
Figure 4B:
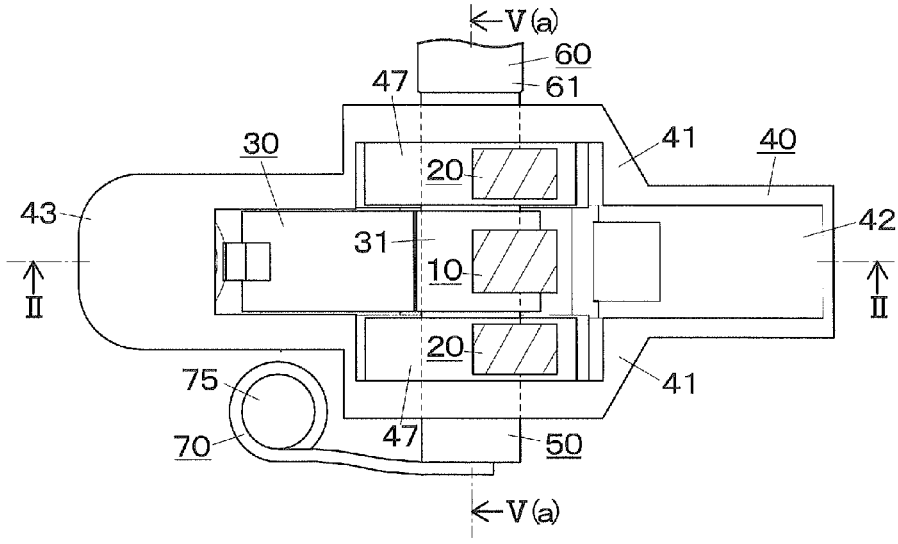
FIG. 4B is a plan sectional view showing the variable valve mechanism according to the first embodiment.

A variable valve mechanism 9 for an internal combustion engine according to a first embodiment shown in FIG. 1 to FIG. 8B is a mechanism for actuating a valve 7 by pressing the valve 7 against the restoring force of a valve spring 8. The variable valve mechanism 9 includes a high lift cam 10, low lift cams 20, 20, an input arm 30, an output arm 40, a switching pin 50, a pressing device 60, a return spring 70 and a stopper mechanism 80 as described below. The pressing device 60, the return spring 70 and the stopper mechanism 80 constitute a displacing device 59 that displaces the switching pin 50. Hereinafter, one side of the output arm 40 in the width direction is called left side, and the other side is called right side; however, the left side and the right side may be interchanged.

High Lift Cam 10

The high lift cam 10 is a cam for pressing the input arm 30 and is provided on a camshaft 25. The high lift cam 10 includes a base circle portion 11 having a perfect circular shape in cross section and a cam nose portion 12 that protrudes from the base circle portion 11.

Low Lift Cams 20, 20

The low lift cams 20, 20 are a pair of cams for pressing the output arm 40, and are provided on both right and left sides of the high lift cam 10 of a camshaft 25. Each of the low lift cams 20 includes a base circle portion 21 having a perfect circular shape in cross section and a cam nose portion 22 that protrudes from the base circle portion 21. The cam nose portion 22 of each low lift cam 20 is lower (smaller in lift amount) than the cam nose portion 12 of the high lift cam 10.

Input Arm 30

The input arm 30 is an arm that rocks as the arm is pressed by the high lift cam 10. The input arm 30 has a supported hole 32 at its rear end portion. A support pin 33 is inserted through the supported hole 32 and support holes 46 that are provided at the rear portion of the output arm 40, so the input arm 30 is rockably supported on the output arm 40 via the support pin 33. A pressed face 31 that contacts the high lift cam 10 is provided on the upper face of the distal end portion of the input arm 30. An actuating portion 35 for actuating the switching pin 50 by pressing the switching pin 50 protrudes from the lower face of the distal end portion of the input arm 30.

Output Arm 40

The output arm 40 is an arm that rocks to actuate the valve 7. The output arm 40 includes outer arm portions 41, 41, a distal end portion 42, a rear end portion 43 and a bottom portion 44. The outer arm portions 41, 41 are provided in parallel with each other on both right and left sides of the input arm 30. The distal end portion 42 couples the distal ends of the outer arm portions 41, 41. The rear end portion 43 couples the rear ends of the outer arm portions 41, 41. The bottom portion 44 is provided between the lower end portions of the outer arm portions 41, 41. The rear end portion 43 is rockably supported by a lash adjuster 48. The distal end portion 42 is in contact with the stem end of the valve 7. A pin hole 45 for inserting the switching pin 50 is extended through the longitudinal middle portion of each of the outer arm portions 41, 41 in the lateral direction. The support holes 46, 46 respectively extend through on the rear side of the pin holes 45, 45 of the outer arm portions 41, 41. A lost motion spring 34 is interposed between the lower face of the input arm 30 and the upper face of the bottom portion 44 of the output arm 40. The lost motion spring 34 urges the input arm 30 toward the high lift cam 10. The output arm 40 includes a pair of rollers 47, 47 that are respectively pressed toward the low lift cams 20 in a non-coupled state where coupling between the input arm 30 and the output arm 40 is released.

Switching Pin 50

The switching pin 50 is a single pin that is inserted through the pin holes 45, 45 of the output arm 40 and extended through the input arm 30 and the output arm 40. The switching pin 50 is provided so as to be displaceable between a right-side coupling position P and a left-side non-coupling position Q. In the right-side coupling position P, the input arm 30 and the output arm 40 are coupled so as to be relatively non-rockable. In the left-side non-coupling position Q, the coupling is released. The left end of the switching pin 50 protrudes leftward and is exposed from the left side face of the output arm 40, and the right end of the switching pin 50 protrudes rightward and is exposed from the right side face of the output arm 40. Different from the related art, the switching pin 50 is not split into multiple pieces between the input arm 30 and the output arm 40 at the non-coupling position Q, and is configured to extend in the lateral direction across the input arm 30 and the output arm 40 at any one of the coupling position P and the non-coupling position Q. An escape groove 53 is provided at the longitudinal middle portion of the switching pin 50. The actuating portion 35 of the input arm 30 is able to enter the escape groove 53 at the time when the input arm 30 rocks in a state where the switching pin 50 is placed at the non-coupling position Q, and the actuating portion 35 of the input arm 30 is not able to enter the escape groove 53 at the time when the input arm 30 rocks in a state where the switching pin 53 is placed at the coupling position P. The pair of rollers 47, 47 are rotatably externally fitted to the switching pin 50 on both right and left sides of the escape groove 53.

Thus, the left-side roller 47, the input arm 30 and the right-side roller 47 are arranged in order from the left side. The right side face of the left-side outer arm portion 41 restricts a leftward displacement of the pair of rollers 47, 47 and the input arm 30, and the left side face of the right-side outer arm portion 41 restricts a rightward displacement of the pair of rollers 47, 47 and the input arm 30.

Pressing Device 60

The pressing device 60 is a device for displacing the switching pin 50 from the right-side coupling position P to the left-side non-coupling position Q by pressing the switching pin 50 leftward. The pressing device 60 is provided rightward of the output arm 40, and does not rock together with any of the input arm 30 and the output arm 40. The pressing device 60 includes a pressing member 61 and a body portion (not shown). The pressing member 61 is provided so as to be displaceable in the lateral direction. The body portion displaces the pressing member 61 in the lateral direction with the use of a variation in hydraulic pressure. The left end face of the pressing member 61 is in contact with the right end face of the switching pin 50.

Return Spring 70

The return spring 70 is a torsion coil spring for pressing the switching pin 50 back from the left-side non-coupling position Q to the right-side coupling position P by pressing the left end face of the switching pin 50 rightward with the distal end portion of the return spring 70. The return spring 70 is supported by a support portion 75 provided leftward of the output arm 40, and does not rock together with any of the input arm 30 and the output arm 40.

Stopper Mechanism 80

The stopper mechanism 80 is a mechanism for stopping a leftward displacement of the switching pin 50 at the non-coupling position Q and stopping a rightward displacement of the switching pin 50 at the coupling position P. The stopper mechanism 80 includes a displacement restricting groove 81 and a lock member 86 as described below. The displacement restricting groove 81 is provided at a portion of the outer periphery of the switching pin 50, which is located just below the escape groove 53, and extends in the lateral direction. The lock member 86 is attached to a fitting hole 87 that extends through the bottom portion 44 of the output arm 40 in the vertical direction, protrudes upward from the fitting hole 87, and is engaged with the displacement restricting groove 81. When a right end 82 of the displacement restricting groove 81 contacts the lock member 86, the switching pin 50 is stopped at the non-coupling position Q. When a left end 83 of the displacement restricting groove 81 contacts the lock member 86, the switching pin 50 is stopped at the coupling position P. The stopper mechanism 80 concurrently serves as a rotation prevention mechanism that prevents rotation of the switching pin 50 with respect to the output arm 40. When an inner side face 84 of the displacement restricting groove 81 contacts the lock member 86, the rotation of the switching pin 50 is prevented.

Next, how the valve 7 is actuated by the variable valve mechanism 9 will be described below separately for [i] a non-coupled state where the switching pin 50 is placed at the non-coupling position and for [ii] a coupled state where the switching pin 50 is placed at the coupling position.

[i] Non-Coupled State

Figure 5A:
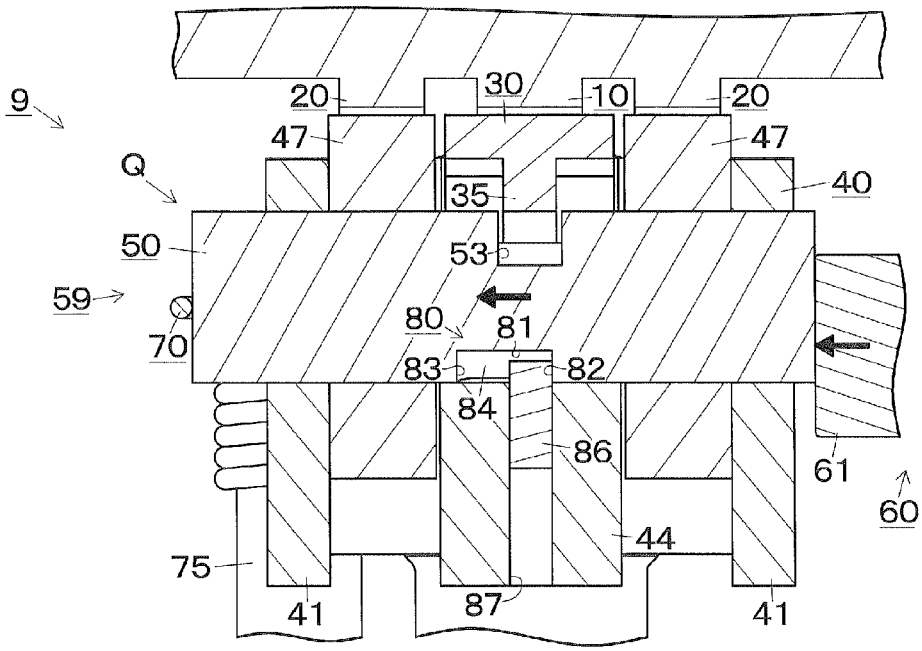
FIG. 5A is a front sectional view showing a non-coupled state of the variable valve mechanism according to the first embodiment.

In the non-coupled state, as shown in FIG. 5A, the pressing member 61 presses the switching pin 50 leftward, so the switching pin 50 is displaced leftward. The leftward displacement is stopped when the right end 82 of the displacement restricting groove 81 contacts the lock member 86. Thus, the switching pin 50 stops at the non-coupling position Q. Therefore, as shown in FIG. 6A, FIG. 6B, FIG. 7A and FIG. 7B, when the actuating portion 35 of the input arm 30 enters the escape groove 53, the input arm 30 relatively rocks (rocks at an idle) with respect to the output arm 40. Thus, the actuating portion 35 of the input arm 30 does not press the switching pin 50. Therefore, the rollers 47, 47 externally fitted around the switching pin 50 are respectively pressed by the low lift cams 20, 20, and the output arm 40 rocks through the cam profiles of the low lift cams 20, 20 to actuate the valve 7.

[ii] Coupled State

Figure 5B:
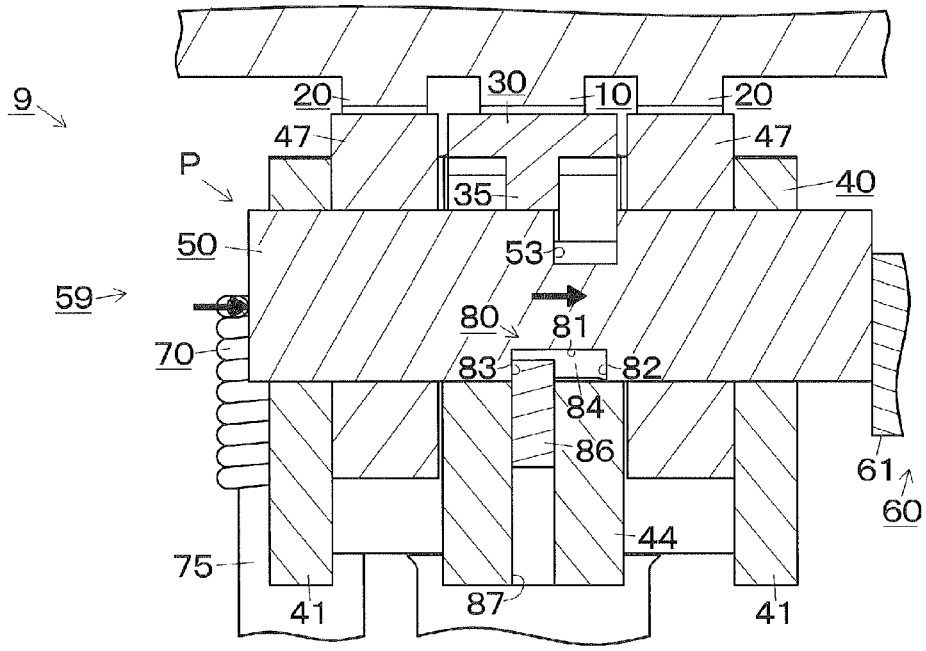
FIG. 5B is a front sectional view showing a coupled state of the variable valve mechanism according to the first embodiment.
Figure 6B:
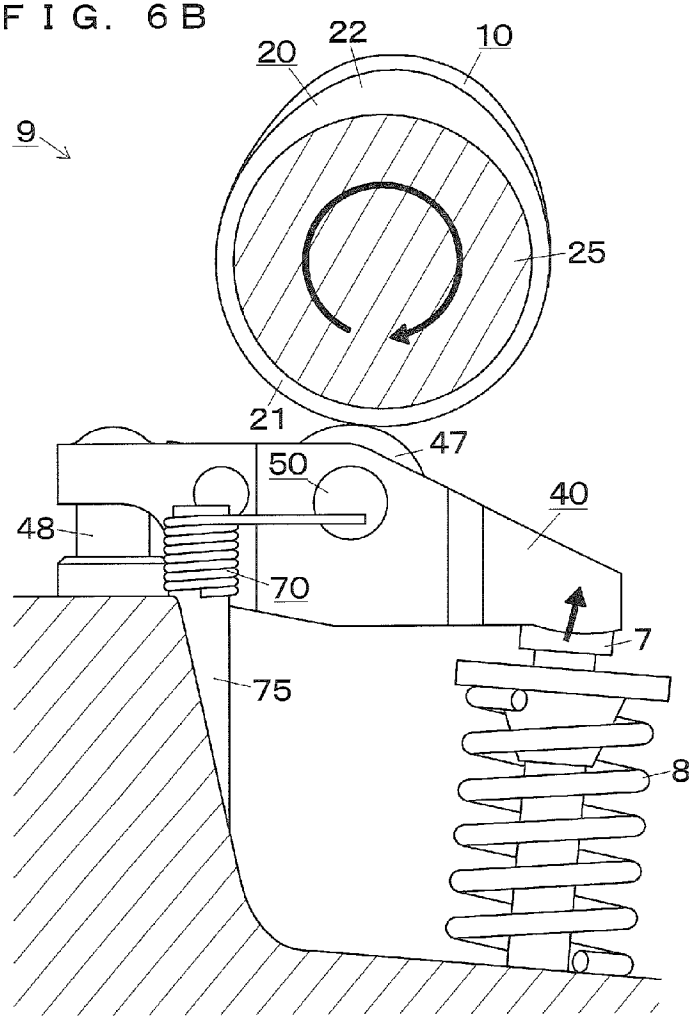
FIG. 6B is a side view showing a non-coupled state of the variable valve mechanism according to the first embodiment at the time of contact of a base circle.
Figure 6A:
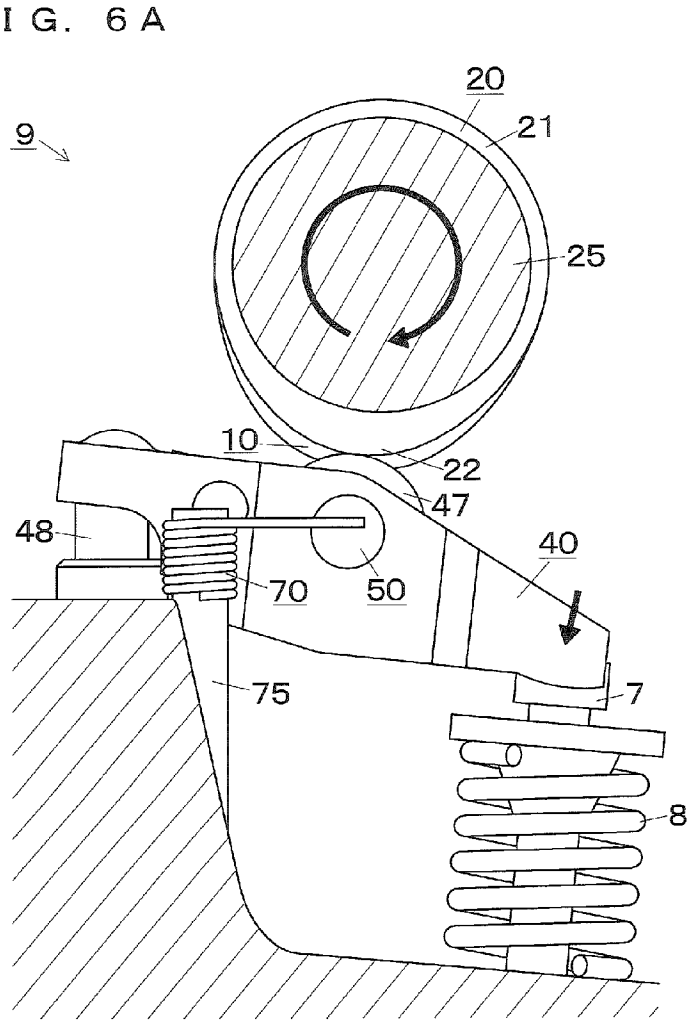
FIG. 6A is a side view showing a non-coupled state of the variable valve mechanism according to the first embodiment at the time of contact of a cam nose.
Figure 7B:
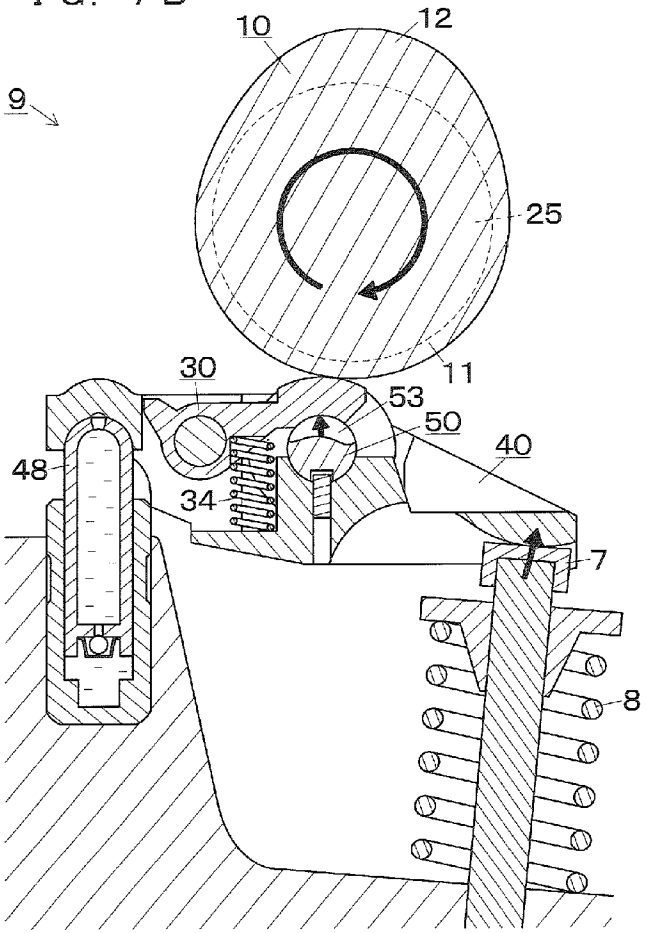
FIG. 7B is a side sectional view showing a non-coupled state of the variable valve mechanism according to the first embodiment at the time of contact of the base circle.
Figure 7A:
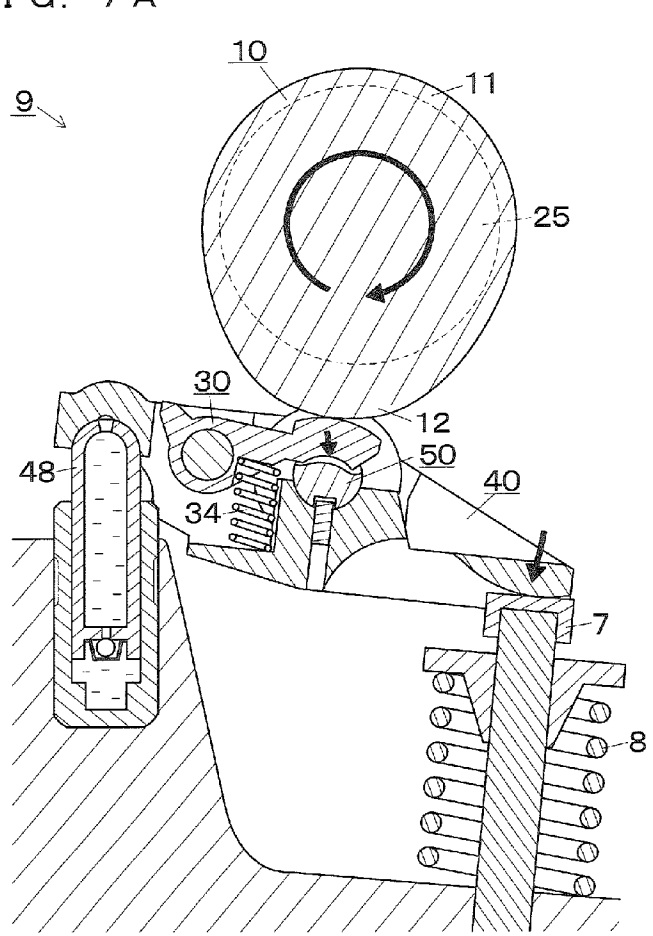
FIG. 7A is a side sectional view showing a non-coupled state of the variable valve mechanism according to the first embodiment at the time of contact of the cam nose.
Figure 8B:
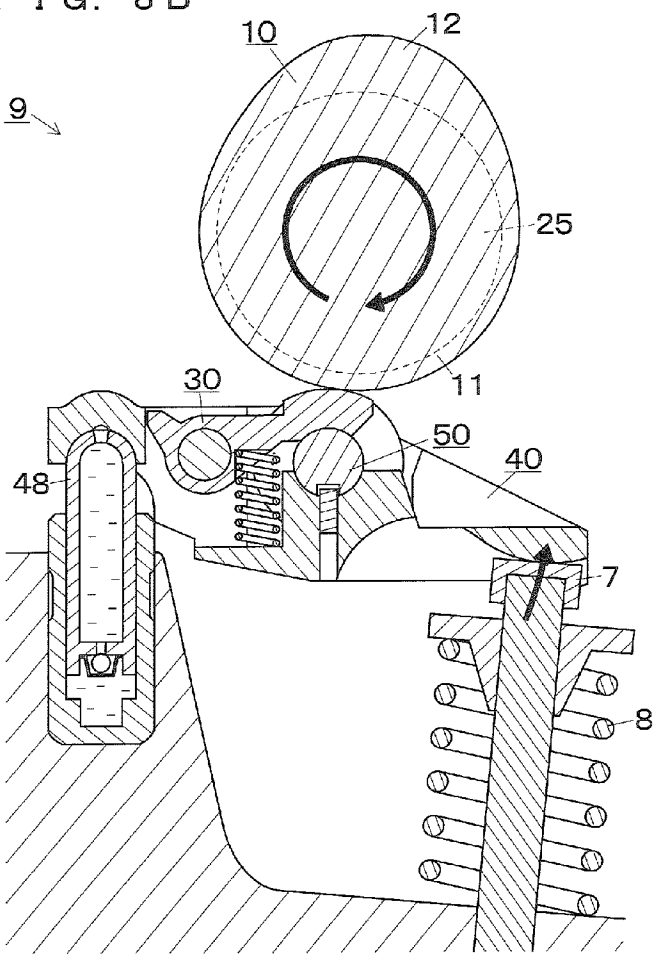
FIG. 8B is a side sectional view showing a coupled state of the variable valve mechanism according to the first embodiment at the time of contact of the base circle.
Figure 8A:
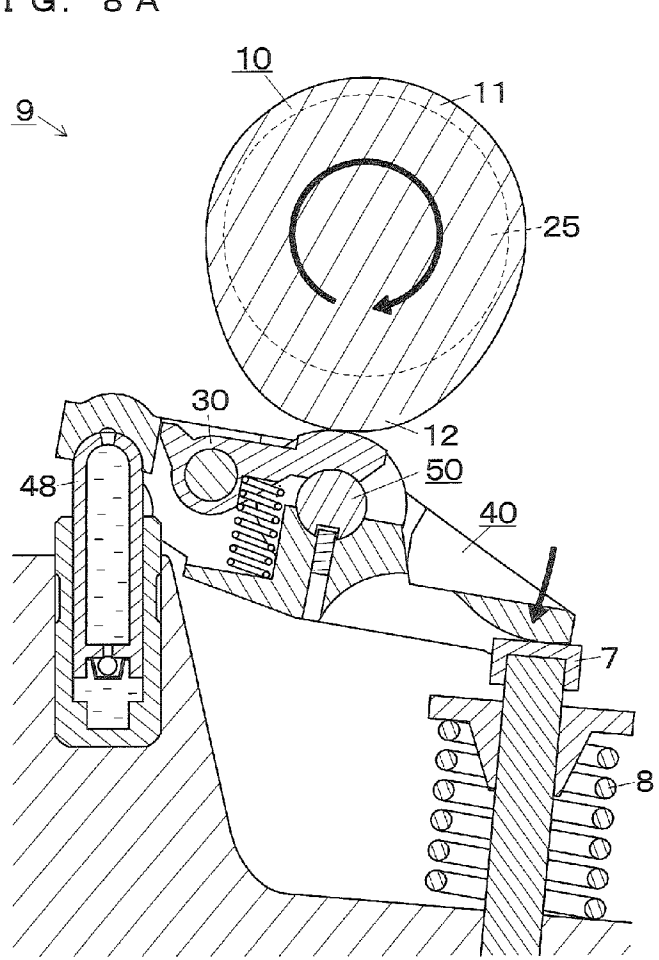
FIG. 8A is a side sectional view showing a coupled state of the variable valve mechanism according to the first embodiment at the time of contact of the cam nose.

In the coupled state, as shown in FIG. 5B, the pressing member 61 does not press the switching pin 50 leftward, so the switching pin 50 is displaced rightward by the restoring force of the return spring 70. The rightward displacement is stopped when the left end 83 of the displacement restricting groove 81 contacts the lock member 86. Thus, the switching pin 50 stops at the coupling position P. Therefore, as shown in FIG. 8A and FIG. 8B, the actuating portion 35 of the input arm 30 does not enter the escape groove 53, and presses the switching pin 50. Therefore, the output arm 40 rocks through the cam profile of the high lift cam 10 together with the input arm 30 to actuate the valve 7.

According to the first embodiment, the following advantageous effects [1] to [4] are obtained.

[1] By providing the return spring 70 outside of the output arm 40, it is possible to reduce the size of the output arm 40 at the left side (in the width direction) and the weight of the output arm 40 in comparison with the related art in which the return spring is provided at the left end of the inside of the output arm. Therefore, it is possible to improve mount ability of the variable valve mechanism 9 to a small-sized engine and the fuel economy of an engine.

[2] The stopper mechanism 80 is formed of the displacement restricting groove 81 provided on the outer periphery of the switching pin 50 and extending in the lateral direction and the lock member 86 engaged with the displacement restricting groove 81. Thus, in comparison with the related art in which the right stopper mechanism and the left stopper mechanism are provided at both right and left end portions of the output arm, it is possible to reduce the size of the output arm 40 in the lateral direction. Furthermore, the stopper mechanism 80 concurrently serves as the rotation prevention mechanism. Thus, it is possible to form the variable valve mechanism 9 in a compact size. Therefore, it is possible to improve mount ability of the variable valve mechanism 9 to a small-sized engine and the fuel economy of an engine. In addition, the displacement restricting groove 81 is located just below the escape groove 53, which enables positioning with high accuracy. The stopper mechanism 80 concurrently serves as the rotation prevention mechanism, so it is possible to fix the switching pin 50 at a predetermined angle with the stopper mechanism 80. By so doing, it is possible to ensure the stroke by which the actuating portion 35 is able to enter the escape groove 53 as much as possible.

[3] The roller shaft that supports the rollers 47, 47 concurrently serves as the switching pin 50. Thus, it is possible to form the single structure of the roller shaft that supports the rollers 47, 47. Therefore, it is possible to simplify the structure of the roller shaft and to reduce the size of the roller shaft in the radial direction. As a result, it is possible to improve mount ability of the variable valve mechanism 9 to a small-sized engine and the fuel economy of an engine.

[4] By providing the escape groove 53 in the switching pin 50, even when the switching pin 50 is not split into three pieces between the input arm 30 and the output arm 40 (outer arm portions 41, 41) at the non-coupling position Q unlike the related art, the single continuous switching pin 50 is able to switch between the coupling and the non-coupling. Therefore, it is possible to simplify the variable valve mechanism 9 and to reduce the size of the variable valve mechanism 9. As a result, it is possible to improve mount ability of the variable valve mechanism 9 to a small-sized engine and the fuel economy of an engine.

[Second Embodiment]

Figure 9B:
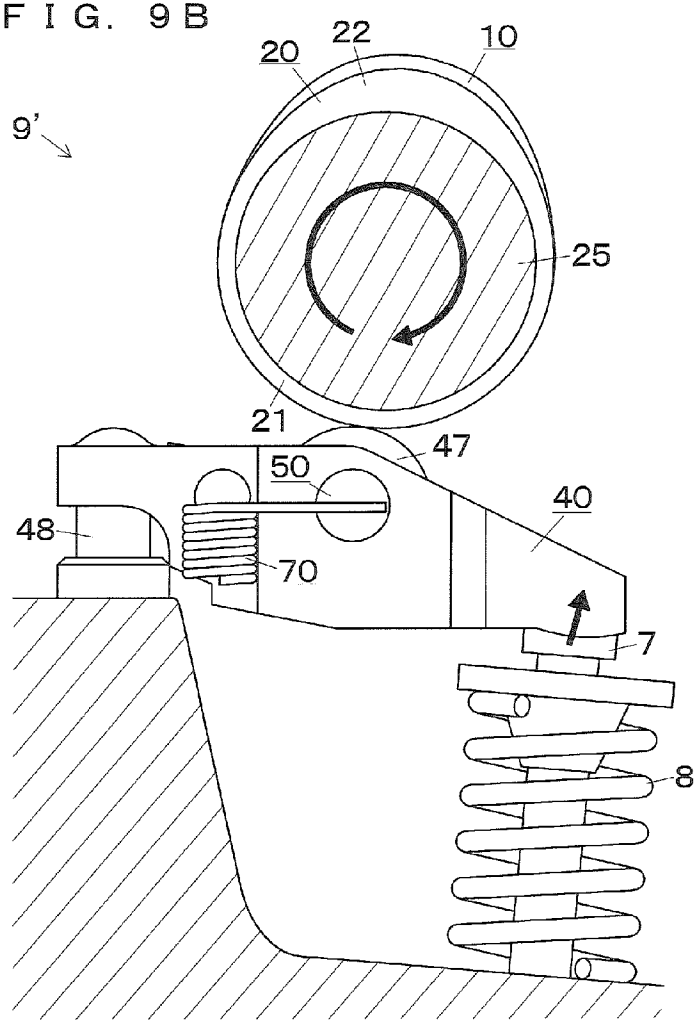
FIG. 9B is a side view showing a non-coupled state of the variable valve mechanism according to the second embodiment at the time of contact of a base circle.
Figure 9A:
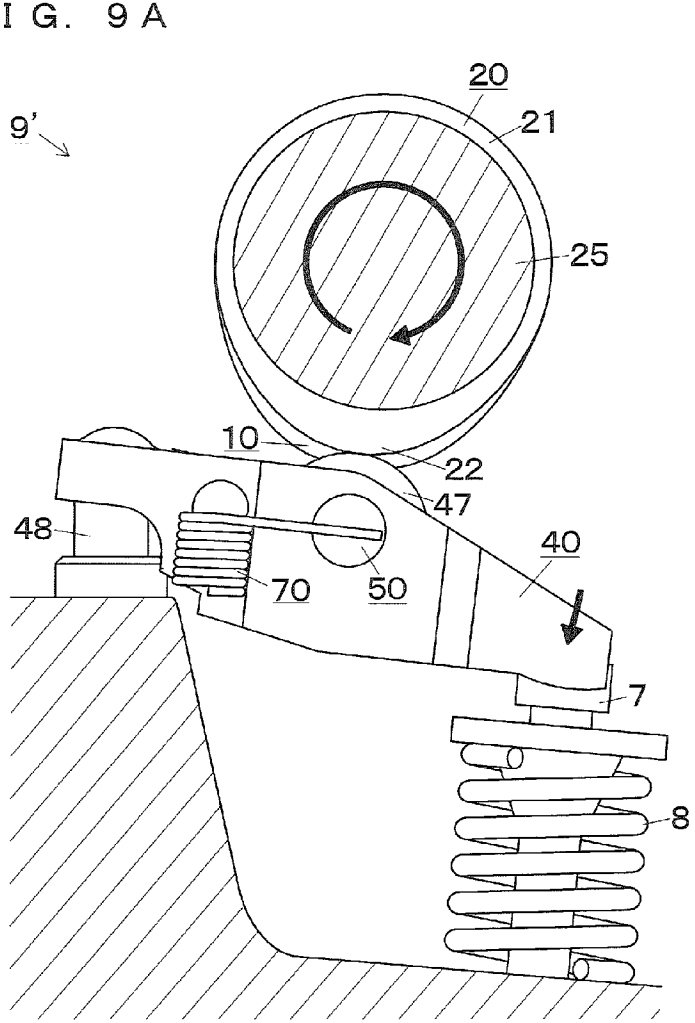
FIG. 9A is a side view showing a non-coupled state of a variable valve mechanism according to a second embodiment at the time of contact of a cam nose.
Figure 10:
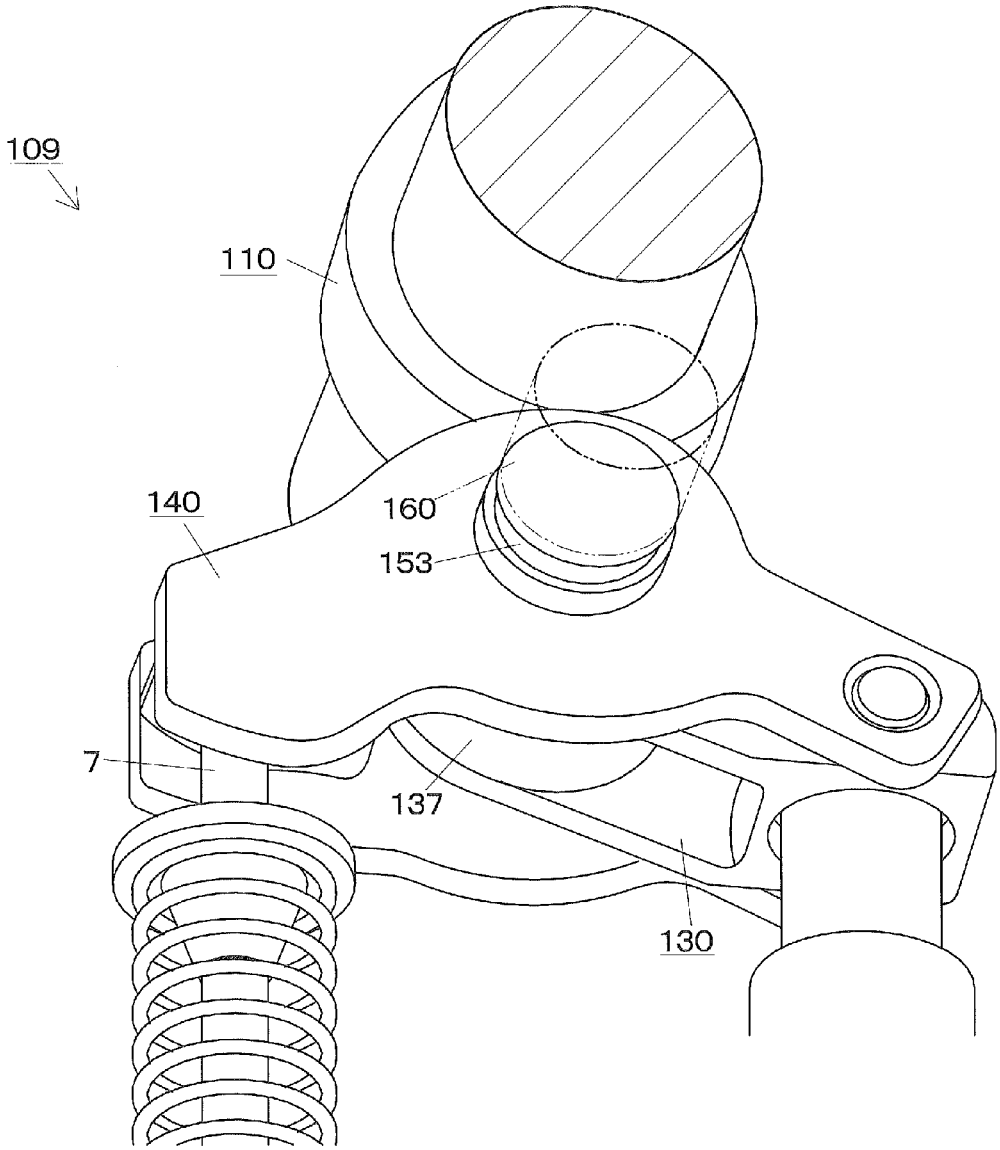
FIG. 10 is a perspective view showing a variable valve mechanism according to the related art.
Figure 11A:
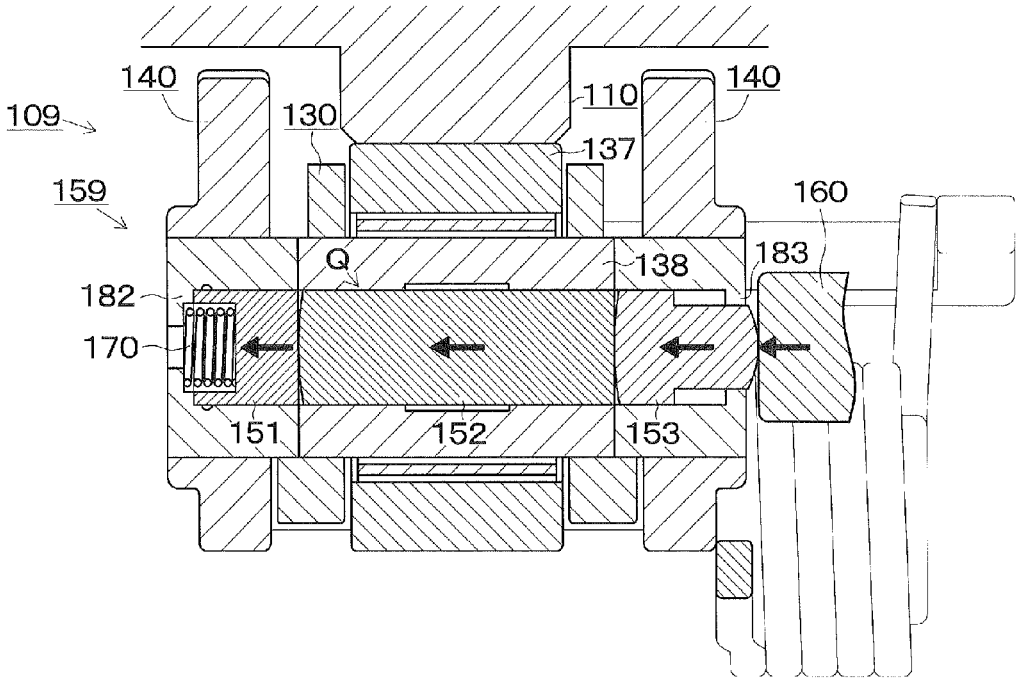
FIG. 11A is a front sectional view showing a non-coupled state of the variable valve mechanism according to the related art.
Figure 11B:
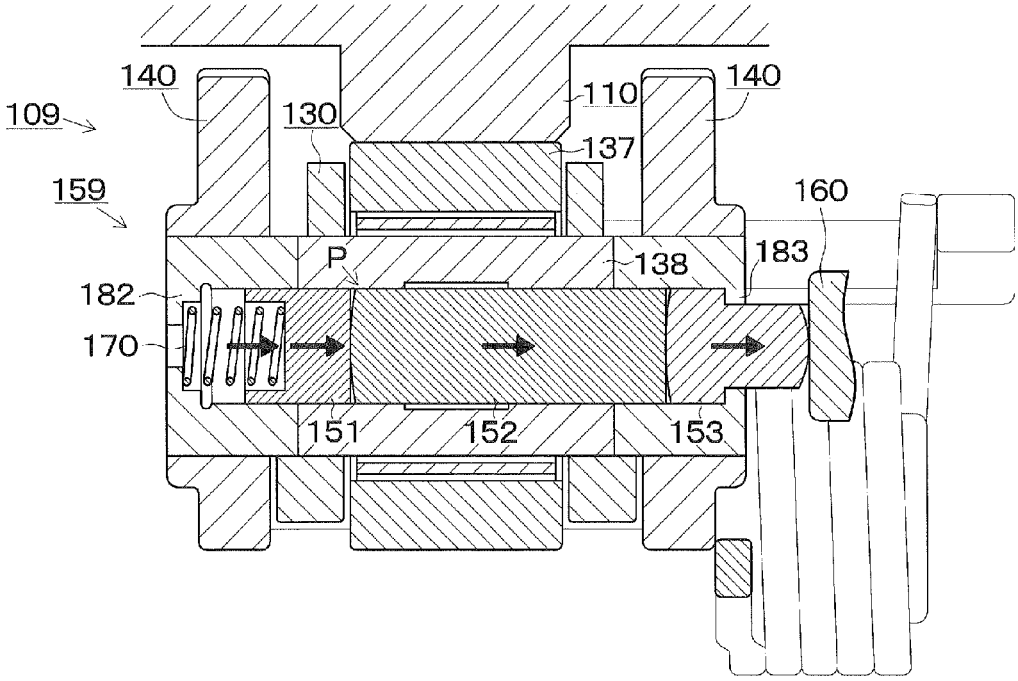
FIG. 11B is a front sectional view showing a coupled state of the variable valve mechanism according to the related art.

A variable valve mechanism 9' for an internal combustion engine according to a second embodiment shown in FIG. 9 differs from the variable valve mechanism 9 of the first embodiment in that the return spring 70 is attached to the left side face of the output arm 40, and is similar in the other respects. Thus, the return spring 70 rocks together with the output arm 40. According to the second embodiment as well, similar advantageous effects to those of the first embodiment are obtained. However, the configuration of the second embodiment is less advantageous in that the output arm 40 is heavier by the weight of the return spring 70 than that of the first embodiment, and is more advantageous in that sliding friction between the return spring 70 and the switching pin 50 disappears.

The invention is not limited to the configurations according to the first and second embodiments. The invention may be implemented by appropriately modifying the configurations according to the first and second embodiments without departing from the scope of the invention. For example, the following first to fourth alternative embodiments are applicable.

First Alternative Embodiment

Instead of displacing the switching pin 50 to the non-coupling position Q by the pressing device 60 and displacing the switching pin 50 to the coupling position P by the restoring force of the return spring 70, the switching pin 50 may be displaced to the coupling position P by the pressing device 60, and the switching pin 50 may be displaced to the non-coupling position Q by the restoring force of the return spring 70. Such a design change may be made by interchanging the coupling position P and the non-coupling position Q laterally by changing the position of the escape groove 53 of the switching pin 50 or may be made by interchanging the position of the pressing device 60 and the position of the return spring 70 laterally.

Second Alternative Embodiment

Instead of forming the pressing device 60 from a hydraulic pressing device that displaces the pressing member 61 in the lateral direction with the use of a variation in hydraulic pressure, the pressing device 60 maybe formed of an electromagnetic pressing device that displaces the pressing member 61 in the lateral direction with the use of a variation in magnetic force.

Third Alternative Embodiment

Instead of rotatably externally fitting the rollers 47, 47, which respectively contact the low lift cams 20, around the switching pin 50, slipper followers that respectively slide over the low lift cams 20 may be provided on the upper face of the output arm 40.

Fourth Alternative Embodiment

Instead of the low lift cams 20, circular cams having a perfect circular shape in cross section may be provided, and a stop state may be set instead of a low lift state.

Reference Signs List

9 variable valve mechanism
9' variable valve mechanism
10 high lift cam (cam)
20 low lift cam (second cam)
30 input arm
40 output arm
47 roller
50 switching pin
53 escape groove
59 displacing device
60 pressing device
70 return spring
80 stopper mechanism
81 displacement restricting groove
82 right end (one end) of displacement restricting groove
83 left end (other end) of displacement restricting groove
84 inner side face of displacement restricting groove
86 lock member
P coupling position
Q non-coupling position

The invention claimed is:

1. A variable valve mechanism for an internal combustion engine, comprising:

an input arm that rocks as the input arm is pressed by a cam;

an output arm that rocks to actuate a valve;

a switching pin that is extended through the input arm and the output arm and that is provided so as to be displaceable between a coupling position at which the switching pin couples the input arm to the output arm such that the input arm and the output arm are relatively non-rockable and a non-coupling position at which the switching pin releases the coupling between the input arm and the output arm; and a displacing device that displaces the switching pin, wherein the displacing device includes: a pressing device that presses the switching pin from any one of the coupling position and the non-coupling position to the other one of the coupling position and the non-coupling position; a return spring that presses the switching pin back from the other one of the coupling position and the non-coupling position to the one of the coupling position and the non-coupling position; and a stopper mechanism that stops a displacement of the switching pin at least at the non-coupling position, the return spring is provided outside of the input arm and the output arm so as to act on one end of the switching pin, the one end of the switching pin being exposed from the input arm and the output arm, and the stopper mechanism includes: a displacement restricting groove that is provided on an outer periphery of the switching pin and that extends in a direction in which the switching pin displaces; and a lock member that is engaged with the displacement restricting groove and that contacts one end of the displacement restricting groove when the switching pin is stopped at the non-coupling position.

2. The variable valve mechanism according to claim 1, wherein the output arm includes a roller that rocks the output arm as the roller is pressed by a second cam different from the cam when the coupling between the input arm and the output arm is released, and the switching pin concurrently serves as a roller shaft that supports the roller such that the roller is rotatable.

3. The variable valve mechanism according to claim 1, wherein the switching pin is formed of a single pin that extends across the input arm and the output arm at any one of the coupling position and the non-coupling position and that is not split between the input arm and the output arm at the non-coupling position, and an escape groove is provided in the single switching pin, the input arm being able to enter the escape groove at the time of rocking at the non-coupling position, and the input arm being not able to enter the escape groove at the time of rocking at the coupling position.

4. The variable valve mechanism according to claim 1, wherein the stopper mechanism concurrently serves as a rotation prevention mechanism that prevents rotation of the switching pin with respect to the output arm, and an inner side face of the displacement restricting groove contacts the lock member to prevent the rotation.

5. The variable valve mechanism according to claim 1, wherein the stopper mechanism stops a displacement of the switching pin at the coupling position, and the lock member contacts the other end of the displacement restricting groove when the switching pin is stopped at the coupling position.

6. The variable valve mechanism according to claim 1, wherein the return spring does not rock together with any of the input arm and the output arm.

7. The variable valve mechanism according to claim 1, wherein the return spring is attached to a side face of the output arm and rocks together with the output arm.

8. The variable valve mechanism according to claim 1, wherein the return spring is a torsion coil spring and presses the switching pin with a distal end portion of the return spring.

9. The variable valve mechanism according to claim 2, wherein the switching pin is formed of a single pin that extends across the input arm and the output arm at any one of the coupling position and the non-coupling position and that is not split between the input arm and the output arm at the non-coupling position, and an escape groove is provided in the single switching pin, the input arm being able to enter the escape groove at the time of rocking at the non-coupling position, and the input arm being not able to enter the escape groove at the time of rocking at the coupling position.

* * * * *